US005965512A

United States Patent [19]

Smyth et al.

[11] Patent Number: 5,965,512

[45] Date of Patent: Oct. 12, 1999

[54] BIODEGRADABLE LIQUID DEGREASER AND PARTS CLEANER COMPOSITION

[76] Inventors: Teresa A. Smyth; Dennis R. Lambert, both of 1072 Dakota Avenue, Ottawa, Ontario, Canada, K1G 2W2

[21] Appl. No.: 09/108,588

[22] Filed: Jul. 1, 1998

[51] Int. Cl.[6] ..... C11D 7/22

[52] U.S. Cl. ..... 510/421; 510/362; 510/365; 510/401; 510/435; 510/461; 510/511; 510/422

[58] Field of Search ..... 510/421, 108, 510/362, 365, 401, 424, 435, 461, 422, 511

[56] References Cited

U.S. PATENT DOCUMENTS

| | | | |
|---|---|---|---|
| 4,414,128 | 11/1983 | Goffinet | 252/111 |
| 4,511,488 | 4/1985 | Matta | 252/162 |
| 5,156,687 | 10/1992 | Ushio et al. | 134/40 |
| 5,190,679 | 3/1993 | McDonald . | |
| 5,516,459 | 5/1996 | Van Eenam | 252/547 |
| 5,520,768 | 5/1996 | Crook et al. | 134/26 |
| 5,605,578 | 2/1997 | Hawes | 134/36 |
| 5,679,628 | 10/1997 | Simpson et al. | 508/583 |
| 5,733,377 | 3/1998 | Howe | 134/3 |

*Primary Examiner*—Margaret Medley
*Attorney, Agent, or Firm*—Pearne, Gordon, McCoy & Granger LLP

[57] ABSTRACT

A biodegradable liquid degreaser for use as a parts cleaner is described. The composition includes from about 0.5% to about 2% by weight of an alkali metal hydroxide; from about 0.5% to about 5% by weight of a corrosion inhibitor; from about 1.5% to about 15% by weight of a biodegradable terpene solvent; from about 5% to about 30% by weight of a biodegradable surfactant; from about 5% to about 15% by weight of a biodegradable co-solvent/co-surfactant and the balance consisting of water. The composition provides excellent degreasing of machine parts while being safe and pleasant to use. The advantage is an inexpensive, completely biodegradable, non-volatile composition for use as a machine part degreaser.

6 Claims, No Drawings

BIODEGRADABLE LIQUID DEGREASER AND PARTS CLEANER COMPOSITION

TECHNICAL FIELD

This invention relates to aqueous cleaning compositions and, in particular, biodegradable liquid degreaser primarily for use as a parts cleaner.

BACKGROUND OF THE INVENTION

The degreasing of machine parts has presented a special cleaning challenge since the use of greases for lubricating machine parts was conceived. Traditionally, the degreasing of machine parts has been accomplished using compositions with petroleum derived or halogenated hydrocarbon solvents or with aqueous compositions containing high levels of caustic and/or phosphates. Such compositions are either hazardous to use, and/or they leave residues that are environmental pollutants which are not readily or easily disposed of. Besides, many of the solvents and compositions are extremely flammable and must be used in carefully controlled environments designed to inhibit fire and explosion.

In recent times, it has been discovered that terpene-based aqueous degreasers may be used to replace the more hazardous compositions described above. Such aqueous cleaners are described, for example, in U.S. Pat. No. 4,414,128 which issued on Nov. 8, 1983 to Goffinet; U.S. Pat. No. 4,511,488 which issued on Apr. 16, 1985 to Matta; and, U.S. Pat. No. 5,679,628 which issued on Oct. 21, 1997 to Simpson et al. These patents describe various cleaning and degreasing compositions which include, as principle components, a terpene and water. A problem with each of the compositions is that they also include one or more constituents which are harmful to the environment. Furthermore, most of these compositions are relatively high in terpene concentration. While d-limonene is one of the most potent, yet easily biodegradable natural terpenes, it is a relatively expensive component of a degreasing composition. It is therefore desirable to provide an effective degreaser which includes a relatively low concentration of terpene in order to conserve costs. It is also desirable to provide a degreasing composition which is completely biodegradable in order to eliminate the introduction of persistent toxic residues into the environment.

SUMMARY OF THE INVENTION

It is therefore an object of the invention to provide a liquid degreaser for use as a parts cleaner which is completely biodegradable.

It is a further object of the invention to provide a liquid degreaser for use as a parts cleaner which effectively removes grease and greasy soil from machine parts without a high concentration of terpene solvent.

It is yet a further object of the invention to provide a liquid degreaser for use as a parts cleaner which leaves an oily film on cleaned parts to act as a corrosion inhibitor.

These and other objects of the invention are realized in a biodegradable liquid degreaser and parts cleaner composition, comprising: from about 0.5% to about 2% by weight of an alkali metal hydroxide; from about 0.5% to about 5% by weight of a corrosion inhibitor; from about 1.5% to 15% by weight of a biodegradable terpene solvent; from about 5% to about 30% by weight of a biodegradable surfactant; from about 5% to about 15% by weight of a biodegradable co-solvent/co-surfactant; and the balance consisting of water.

The composition in accordance with the invention provides a clear, stable liquid degreaser which is pleasant to handle, effectively removes grease from machine parts and is 100% biodegradable. The degreaser is non-toxic for external use, does not contain volatile toxic solvents and does not attack the skin. The composition can therefore be used in an open environment without fear of fire or explosion. It can also be used without protective clothing and may be used without gloves or other equipment to protect the hands.

The alkaline metal hydroxide in the composition is preferably potassium hydroxide. The corrosion inhibitor is preferably sodium metasilicate. The terpene solvent is preferably d-limonene. The preferred surfactant is a $C_2$–$C_8$ linear alcohol ethoxylate. 2-butoxyethanol is preferably used as the co-solvent/co-surfactant.

DETAILED DESCRIPTION OF THE PREFERRED EMBODIMENT

The biodegradable liquid degreaser for use as a parts cleaner composition in accordance with the invention comprises less than about 2% by weight of an alkali metal hydroxide, less than about 5% by weight of a corrosion inhibitor, less than about 15% by weight of a biodegradable terpene solvent, less than about 30% by eight of a biodegradable surfactant, less than about 15% by weight of a biodegradable co-solvent/co-surfactant and a balance consisting of water.

The preferred terpene solvent is d-limonene which is one of the most potent, yet easily biodegradable natural terpenes. D-limonene also imparts a pleasant orange odour to the composition which improves its desirability as a parts cleaner.

The amount of biodegradable terpene solvent in the composition is preferably less than 15% by weight and more preferably less than 6% by weight. In a preferred embodiment of the invention in accordance with the invention, the concentration is 5.4% by weight of d-limonene in the composition. In spite of the low concentration of d-limonene in the composition, the liquid degreaser in accordance with the invention is very effective in removing grease and greasy soils from machine parts. The composition in accordance with the invention is particularly useful as a degreaser for bicycle parts and was specifically designed for bicycle maintenance applications, although it is in no way limited to such applications and may be used in any environment where effective, non-toxic degreasing of machine parts is accomplished using manual and/or automated methods of cleaning.

The alkali metal hydroxide in the solution serves as a degreaser to augment the action of the d-limonene as well as an emulser/stabilizer. The preferred alkali metal hydroxide is potassium hydroxide, although sodium hydroxide may also be used.

A corrosion inhibitor is included in the composition to counter the mild corrosion effects of the water and the alkali metal hydroxide in the composition. The preferred corrosion inhibitor is sodium metasilicate although other alkali metal metasilicates can also be used for the same purpose.

The biodegradable surfactant is used as a surface active blending agent to assist in binding the terpene to the water. The preferred biodegradable surfactant is a linear alcohol ethoxylate. The linear alcohol ethoxylates have replaced the alcohol benzene sulfonates commonly used in the prior art because they are readily decomposed by micro-organisms. Besides helping to bind the terpene to water, the linear alcohol ethoxylate also assists in the cleaning action. The preferred linear alcohol ethoxylate is a $C_2$–$C_8$ linear alcohol derivative. Ethanol ethoxylate is a suitable surfactant. The amount of biodegradable surfactant in the composition is preferably less than about 30% and more preferably less than 14%.

The biodegradable co-solvent/co-surfactant in the composition is preferably 2-butoxy ethanol which is a non-polar solvent. It has very powerful solvent/detergent qualities and is completely soluble in water. It also assists in stabilizing the composition to prevent the separation of the d-limonene/surfactant/water bond.

The balance of the composition consists of water. In the preferred embodiment of the invention, the water content is about 74.6% by weight. While this concentration of water is considerably greater than other prior art compositions intended for use with as degreasers, the composition is suprisingly effective in removing grease and greasy soil from machine parts. Extensive field trials have shown that in spite of the fact that the composition is non-toxic and pleasant to handle, it is thoroughly effective as a machine part degreaser.

Independent laboratory tests have also been undertaken to determine the biodegradability of the liquid degreaser in accordance with the invention. It has been determined that the d-limonene component is 100% biodegradable within a maximum period of about eight days. The other additives in the composition have been determined to be within about 79 to 88% biodegradable to 28 days with 100% degradation occurring over a period of from about 36 to about 110 days. These results indicate the excellent biodegradability of the components in the compositions. Although the rate of biodegradation is dependent on environmental factors, given average conditions, residual environmental contaminations is eliminated over a maximum period of 3 and a half months and at least 85% of residual environmental contamination is eliminated within a maximum of 15 days. The composition in accordance with the invention thereby provides an environmentally compatible degreaser which is both pleasant and effective to use as a machine parts cleaner.

In the preferred embodiment of the invention, the liquid degreaser and parts cleaner composition includes 0.9% by weight potassium hydroxide; 0.9% by weight of sodium metasilicate; 5.4% by weight of d-limonene; 13.2% by weight of linear alcohol ethoxylate; 5% by weight of 2-butoxyethanol; and 74.6% by weight of water.

Changes and modifications to the above-described preferred embodiments will no doubt become apparent to those skilled in the art. The scope of the invention is therefore intended to be limited solely by the scope of the appended claims.

We claim:

1. A biodegradable liquid degreaser and parts cleaner composition, consisting essentially of:

a) from about 0.5% to about 2% by weight of an potassium hydroxide;

b) from about 0.5% to about 5% by weight of a sodium metasilicate corrosion inhibitor;

c) from about 1.5% to about 9.5% by weight of a biodegradable d-limonene solvent;

d) from about 5% to about 30% by weight of a $C_2$–$C_8$ linear alcohol ethoxylate;

e) from about 5% to about 15% by weight of 2-butoxyethanol co-solvent/co-surfactant; and f) water.

2. A biodegradable liquid degreaser and parts cleaner composition as claimed in claim 1 wherein the linear alcohol is ethanol ethoxylate.

3. A biodegradable liquid degreaser and parts cleaner composition, consisting of:

a) from about 0.5% to about 2% by weight of potassium hydroxide;

b) from about 0.5% to about 5% by weight of sodium metasilicate;

c) from about 1.5% to 15% by weight of a biodegradable d-limonene;

d) from about 5% to about 30% by weight of a $C_2$–$C_8$ linear alcohol ethoxylate;

e) from about 5% to about 15% by weight of 2-butoxyethanol; and f) the balance consisting of water.

4. A biodegradable liquid degreaser and parts cleaner composition as claimed in claim 3 wherein the d-limonene constitutes from about 5% to about 10% by weight of the composition.

5. A biodegradable liquid degreaser and parts cleaner composition as claimed in claim 4 wherein the d-limonene constitutes from about 5% to about 6% by weight of the composition.

6. A biodegradable liquid degreaser and parts cleaner composition, consisting of:

a) 0.9% by weight of potassium hydroxide;

b) 0.9% by weight of sodium metasilicate;

c) 5.4% by weight of d-limonene;

d) 13.2% by weight of a $C_2$–$C_8$ linear alcohol ethoxylate;

e) 5% by weight of 2butoxyethanol; and f) 74.6% by weight of water.

* * * * *